US009600971B2

(12) United States Patent
Pececnik

(10) Patent No.: US 9,600,971 B2
(45) Date of Patent: Mar. 21, 2017

(54) SECOND PLAYER ELECTRONIC WAGERING SYSTEM

(71) Applicant: Joze Pececnik, Smarca (SI)

(72) Inventor: Joze Pececnik, Smarca (SI)

(73) Assignee: INTERBLOCK D.D., Menges (SI)

( * ) Notice: Subject to any disclaimer, the term of this patent is extended or adjusted under 35 U.S.C. 154(b) by 370 days.

(21) Appl. No.: 14/069,162

(22) Filed: Oct. 31, 2013

(65) Prior Publication Data

US 2015/0119131 A1 Apr. 30, 2015

(51) Int. Cl.
*A63F 9/24* (2006.01)
*G07F 17/32* (2006.01)

(52) U.S. Cl.
CPC ..... *G07F 17/3272* (2013.01); *G07F 17/3209* (2013.01); *G07F 17/3211* (2013.01); *G07F 17/3216* (2013.01)

(58) Field of Classification Search
CPC ..... G07F 17/3288; G07F 17/3211; G07F 17/3213; G07F 17/3262; G07F 17/3223; G07F 17/3272; G07F 17/3202; G07F 17/3216; G07F 17/326; G07F 17/34; A63F 13/08
See application file for complete search history.

(56) References Cited

U.S. PATENT DOCUMENTS 4,467,424 A 8/1984 Hedges
4,636,951 A 1/1987 Harlick
4,856,787 A 8/1989 Itkis
4,958,381 A * 9/1990 Toyoshima ..... 725/75
5,324,035 A 6/1994 Morris
5,390,934 A 2/1995 Grassa
5,486,005 A 1/1996 Neal
5,494,296 A 2/1996 Grassa
5,573,249 A 11/1996 Johnson
5,586,937 A 12/1996 Menashe
5,615,888 A 4/1997 Lofink
5,673,917 A 10/1997 Vacura
5,713,633 A * 2/1998 Lu ..... 297/364
5,806,846 A 9/1998 Lofink
5,851,149 A 12/1998 Xidos
(Continued)

*Primary Examiner* — Justin Myhr
(74) *Attorney, Agent, or Firm* — Mark A. Litman & Associates, P.A.

(57) ABSTRACT

A wagering apparatus enables play of that game on an underlying electronic gaming apparatus. The apparatus includes:

a) a first player position and input controls at the first player position;
b) the processor is in communication with the first player input controls;
c) a first player seat at each first player position;
d) a second player input control associated with the player seat more distal from the gaming apparatus than the first player seat;
e) the second player input control in communication with the processor and having second player input controls that enable wagering on any wagering game on the gaming apparatus; and
f) the processor configured to accept wagers from both the first player input controls and the second player input controls and to resolve wagers from the first player input controls and the second player input controls based upon game outcomes on the gaming apparatus.

20 Claims, 3 Drawing Sheets

(56) References Cited

U.S. PATENT DOCUMENTS

| | | | | |
|---|---|---|---|---|
| 5,863,041 | A | 1/1999 | Boylan | |
| 5,868,392 | A | 2/1999 | Kraft | |
| 6,368,218 | B2 | 4/2002 | Angell, Jr. | |
| 6,607,195 | B2 | 8/2003 | Vancura | |
| 6,676,522 | B2 | 1/2004 | Rowe | |
| 6,755,741 | B1 | 6/2004 | Rafaeli | |
| 6,846,238 | B2 | 1/2005 | Wells | |
| 6,929,264 | B2 | 8/2005 | Huard | |
| 8,142,269 | B2 * | 3/2012 | Tsukahara | 463/6 |
| 2001/0034268 | A1 * | 10/2001 | Thomas et al. | 463/40 |
| 2002/0198052 | A1 * | 12/2002 | Soltys | G07F 17/3237 463/42 |
| 2003/0152893 | A1 * | 8/2003 | Edgar | 434/37 |
| 2004/0162144 | A1 | 8/2004 | Loose | |
| 2004/0248651 | A1 | 12/2004 | Gagner | |
| 2007/0026936 | A1 * | 2/2007 | Gatto et al. | 463/25 |
| 2007/0111775 | A1 | 5/2007 | Yoseloff | |
| 2008/0058048 | A1 * | 3/2008 | Lutnick | G07F 17/3232 463/16 |
| 2008/0060025 | A1 * | 3/2008 | Chen | 725/74 |
| 2011/0109134 | A1 * | 5/2011 | Filipour et al. | 297/217.4 |
| 2011/0159940 | A1 * | 6/2011 | Acres | 463/11 |
| 2012/0322564 | A1 * | 12/2012 | Granger et al. | 463/46 |

* cited by examiner

SECOND PLAYER ELECTRONIC WAGERING SYSTEM

BACKGROUND OF THE INVENTION

1. Field of the Invention

The present technology relates to the field of wagering, casino environment wagering, live player wagering and secondary player wagering on a live player position.

2. Background of the Art

One of the objectives of casinos and the gaming industry is to enable the largest number of wagers and the largest amount of wagers on individual game events. Increasing the number of players at tables, increasing the size of banks of video equipment and increasing the maximum size of wagers at games have been the traditional ways of addressing this goal.

The advent of electronic wagering and electronic event outcomes capability at gaming tables has simplified wager resolution has sped up table game play, reduced fraud potential and enabled the development of additional side bets and more complex wagers or compound wagers.

Numerous formats for implementing electronic wagering at gaming tables have been implemented. U.S. Pat. No. 4,856,787 (Itkis) describes a distributed game network comprising a master game device and a number of slave game devices. The slave game device is capable of playing concurrently and in real-time, a number of menu selectable electronic card and chance games, such as poker, bingo, blackjack, and keno. The slave game device receives commands and random data, such as bingo patterns and called bingo and keno numbers, from the master game device and sends the local game status and accounting information to the master game device. The slave game device is equipped with a touch screen display and a smart game card interface. The smart game card associated with the slave game device is read/write and has an imbedded microprocessor keeping track of wagers and outcomes of the game. The touch screen display exhibits the status of the games being played in display windows and accepts player's commands including menu selections and bingo and keno card marks. The status of all the games being played with the help of a slave game device is presented on a touch screen display in individual windows dedicated to specific games. The display also shows the accounting data pertinent to all the games, such as wagers, prizes, and balances. Being a touch screen device, the display facilitates the selection of the games, the modes of playing the selected games, and the values of bets. In addition, the touch screen provides an opportunity to manually mark bingo and keno matches on the screen. The smart game card associated with the slave game device is equipped with an imbedded microprocessor keeping track of bets and outcomes of the games. In addition, the smart game card stores in encoded form the information identifying the content of the game card images presented on the display, e.g. bingo card contents.

U.S. Pat. No. 4,467,424 (Hedges et al.) describes a remote gaming system for use with a wagering or gambling establishment such as a casino to enable a player's participation in a selected one of a plurality of wagering games from a remote location. The system includes a croupier station, a credit station and a player station remotely located from the croupier station and the credit station. The player station includes a live game display for displaying a selected one of a plurality of games being played at the croupier station, such as craps, roulette or keno. The player station includes a changeable playboard for displaying a selected one of a plurality of wagering possibilities corresponding to a selected one of the plurality of games being played and for displaying the results of the game played at the croupier station. The player station also includes a microprocessor for controlling the operation of the live game display and the changeable playboard. A remote gaming terminal is provided which includes a live game display for displaying a selected one of a plurality of games being played such as craps, roulette or keno. The terminal also includes a playboard for displaying a selected one of a plurality of wagering possibilities corresponding to a selected one of a plurality of games being played. The playboard also displays the results of the game played upon completion. The playboard includes means for changing the display to enable participation in any of the games being played. Processor means are included for controlling the operation of the terminal.

U.S. Pat. No. 5,324,035 describes a gaming system is provided including a central game processor, a plurality of master processing units and a plurality of slave terminals operable by players to play the game. The central game processor communicates with the master processing units and supplies the various games available in the system. The master processing units store and administer the games as they are played on the slave terminals connected to each respective master processing unit. A preferred game includes a fixed pool of game plays and a predetermined number of winning plays within each pool. Each player, through his or her slave terminal, can purchase plays in each fixed pool stored in the master processing unit to which that terminal is coupled. When a particular pool is exhausted, for example, through the purchase of all plays, the central game processor provides another fixed pool of plays to that master processing unit to enable continuous play. The gaming system includes a central game processor, which controls and administers operation of the gaming system. Preferably, remotely located from the central game processor are multiple master processing units. In one embodiment of the invention, the master processing units are connected to the central game processor employing a telephone link. In this embodiment, up to sixteen telephone lines are used to connect between modems provided with each master processing unit and the multiple-line modems provided in the central game processor. A plurality of slave terminals are in turn connected to each master processing unit. According to the preferred embodiment, up to twenty slave terminals can be configured to each master processing unit. In this embodiment, the slave terminals are interconnected through a local area network (LAN). The local area network also couples the slave terminals to their respective master processing unit.

U.S. Pat. No. 4,636,951 (Harlick) describes a system for controlling the operation of electronically linked gaming machines which enables information to be transferred between machines and from each machine to a control unit. In particular, credits on a machine can be transferred to another machine and the credit state of each machine can be interrogated and adjusted from the central control unit.

Published U.S. patent application 2004/0248651 (Gagner) describes a method and a system of using a gaming network having a server in communication with a plurality of gaming terminals to share gaming applications directly between selected gaming terminals using a peer-to-peer type communications architecture. The method and system are a combination of hardware and software, that controls the initiation of a shared game, determines the gaming terminals eligible to participate in the game, accepts or rejects their participation, and subsequently establishes virtual communication network directly between participating gaming terminals. The virtual communication network is established allow a gaming terminal to act as a server of the shared application to all other participating gaming terminals. Once the application has been run to completion, the server terminates the session and returns each gaming terminal back to its normal operating mode. The Gagner invention provides a gaming system and method for allowing multiple gaming terminals to participate in shared game play occurring at another terminal. The shared game experience may be competitive or collaborative. Participation in the game may be passive, such as placing a side bet. Participation may also be active, such as direct competition with other players, or collaborative team play.

Published U.S. patent application No. 2004/0162144 (Loose et al.) describes a system and method for allowing players at gaming terminals to communicate with each other. The gaming terminals are used to conduct wagering games. One of the gaming terminals generates a personal message in response to input of a player at the one of the gaming terminals. A least one other of the gaming terminals presents the personal message. The personal message may include text, audio, or video content and may be generated via such messaging technologies as electronic mail, instant messaging, a chat room, network telephony, conferencing, and an electronic message center.

U.S. Pat. No. 6,929,264 (Huard et al.) describes a method and system for playing an auxiliary casino game managed by a casino house comprising: selecting at least one player of an underlying casino game on which to place a bet; identifying at least one event related to at least one play of the underlying game for which to place the bet; making a bet that at least one event will occur in association with a player during at least one play of the underlying game; determining an occurrence of the event in the underlying game in association with the player; if the event occurred in association with the at least one player, determining a payout to be paid. The system offers players the possibility to bet on an event received by another player in conjunction with or independently of participating in the underlying game. Indeed, certain players, feeling unlucky or inexperienced at the game may prefer to bet only on a particular event to be received by at least one player during the course of the play of the underlying game. This way, they can participate and have the chance to win, and at the same time, become more knowledgeable of the game rules and strategies. Players who feel lucky can participate in the underlying game, and furthermore can take advantage of lucky or unlucky periods of other players, including the dealer, by making bets that these players will obtain certain event. For example, a player who feels lucky may want to maximize his earnings during this lucky period, he will then bet on his own hand but might also enjoy betting on the other players' hands. The patent is prophetic in stating that apparatus or equipment must be developed to enable wagering on other players' hands.

U.S. Pat. No. 5,868,392 (Kraft) describes a method and apparatus for playing a poker game with a unique betting format. According to the invention, a method and apparatus for playing a poker game with a unique betting format is disclosed. A card game played according to a preferred embodiment of the present invention is somewhat similar in spirit to traditional poker. However, individual players can place a multitude of different types of bets that aren't normally associated with traditional poker. For instance, individual players can choose to bet on which hand will win, players can bet on which group of adjacent players' stations will contain the winning hand, players can bet on which combination of cards will win, and, finally, players can bet on certain specialty bets, such as betting that the winning hand will be at least three-of-a-kind comprising jacks or better.

U.S. Pat. No. 5,573,249 (Johnson) describes a method for playing a card game comprising the steps of providing at least one player with an opportunity to place a wager, displaying a first plurality of playing card indicia to form a plurality of partial card hands, allowing the player to assign the wager to one of the plurality of partial card hands, and subsequently completing the card hands by displaying an additional plurality of card indicia. When the hands have been completed, a winning payout is provided to any and all players who successfully assigned their wagers to the partial card hand which resulted in the complete hand having a particular value, e.g. the highest poker ranking.

U.S. Pat. No. 5,486,005 (Neal) describes a method and apparatus for playing a poker-like game with a deck of fifty-two playing cards wherein each player plays against the dealer. After each player makes a wager, the dealer deals four initial cards of the deck face up to seven separate hands, places odds on each hand according to predetermined guidelines, and selects two of the seven hands as a combination field position. Each player then selects either one of the hands, the field position, or a no-hand winning position which requires that none of the seven hands, after all cards are dealt, have two pairs or better. After each player selects a hand or a position, the dealer deals three more cards of the deck face up to each of the seven separate hands. The dealer then determines the winning hand or position and pays each player who selected the winning hand or position according to the odds and their wager or collects each player's wager who did not select the winning hand or position. Additionally, a jackpot wheel may be included to permit an added possibility of winning a larger payout.

U.S. Pat. No. 6,846,238 (Wells) describes a disclosed gaming machine provides methods and apparatus for operating a wireless game player that presents a game of chance executed on a gaming machine in communication with the wireless game player. In one embodiment, the wireless game player is a hand-held mobile device, electronically linked to a licensed gaming machine via a wireless connection. All random number generation (RNG) events, game outcomes, meter information, game related information, and all cash transactions are maintained in the licensed (controlled) gaming machine and not the wireless game player. The wireless game player may be used anywhere within the legal areas of the casino and it has the capability of identifying who is using it. For example, a biometric input device, such as a finger print reader may be used on the wireless game player to identify the player. Thus, the issue of under-age or excluded players is addressed.

U.S. Pat. No. 5,851,149 (Xidos et al.) describes a Distributed Gaming System that provides a user with remote location gaming, for example from within a hotel room. Using the room's television and a remote control, the user, such as a hotel guest, is able to play games similar to those available on a Video Lottery Terminal. The games are displayed on a TV through the use of a TV set-top box. The set top box connects the TV to a network of computer systems through which the Gaming System is distributed and managed. Game access is obtained using a payment swipe device. A special feature of system is the progressive jackpots that are available to game players; these jackpots are at the hotel, jurisdiction, and global levels.

U.S. Pat. No. 5,586,937 (Menashe) describes a gaming system that includes a host computer, a plurality of general purpose terminal computers forming player stations remote from the host, means for providing communication between each of the terminals and the host. Each terminal has a program for generating screen graphics and sound locally in response to control data packets generated by and received from the host. The host generates random numbers for a game being played on a connected terminal within preset criteria for that game in response to data packets received from the terminal. The data packets are of variable length between 1 and 80 bytes. The host sequentially stores the minimum significant information for replaying a game, auditing and security, such as accounting data of each player at the start of each game, random numbers generated by the host, responses received from a player, and whether a game was completed. Play is substantially real-time, because only minimal data is transmitted with functions requiring large amounts of data, such as screen graphics being generated locally. The statuses of host and terminal are restored automatically on re-establishing communication following an interruption to ensure fairness to players and prevent them defeating the outcome of a game.

U.S. Pat. No. 6,755,741 (Rafaeli) describes a gambling game system comprising a central station including a plurality of betting-type game devices, and an electronic camera for providing images of each game device. A plurality of player stations are remotely located with respect to the central stations, each one including a monitor for displaying a selected game device at the central station, and input means for selecting a game device and for placing a bet by a player at the player's station relating to an action involving an element of change to occur at the selected game device. Data processing means are provided for: (a) establishing communication between the central station and each of the player stations; (b) enabling a player at each player station via the input means at the player station to select a game device at the central station, to see via the monitor at the player station what occurs at the selected game device, and to place a bet via the input means at the player station relating to the action involving an element of chance to occur at the selected game device; (c) displaying in the monitor at the player's station the action involving an element of chance as the action occurs at the selected game device; (d) determining whether the action, after it occurs, resulted in a "win" or "loss" of the placed bet; and (e) maintaining a current account for the player in which each win is registered as a credit, and each loss is registered as a debit, according to the rates of the selected game device. Such a system preferably utilizes an actual casino as the central station and displays the actual game device to the remotely-located player during the actual playing of the game. Thus, the system in effect moves the player to the casino, or the casino to the player. This increases the feeling and excitement in the remotely-located players of being present in a real gambling casino. It also increases the confidence of the players in the integrity of the system against the possibility of electronic manipulation. According to further preferred features, the casino also includes a microphone at each game device; and each of the players stations also include a speaker; enabling a player at each player station to hear, as well as to see, what occurs at the selected game device as it occurs at the casino. These features add to the transfer of the gambling casino atmosphere to the remotely-located player's station, and to the confidence of the players in the integrity of the system against the possibility of manipulation.

U.S. Pat. No. 6,676,522 (Rowe et al.) describes a gaming system including hand-held, portable gaming devices. In one embodiment, the gaming system is arranged to present at least one game to a player and includes a portable gaming device or interface having a display for displaying game and other information to a player. The portable gaming device is capable of receiving and sending information to a remote device/location. A game server generates game data, and transmits the game data to the portable gaming device and receives information, such as player input, from the portable gaming device. A payment transaction server validates payment and establishes entitlement of a player to play a game via the portable gaming device as provided by the game server. In one or more embodiments, the gaming system includes one or more stationary gaming machines capable of printing tickets having a value associated therewith. The portable gaming device includes a ticket reader for reading ticket information for use by the payment transaction server in verifying the associated value for establishing entitlement of a player to play the game. Preferably, communication to and from the portable gaming device is via a wireless communication channel.

U.S. Pat. Nos. 5,673,917 and 6,607,195 (Vancura) describe a method for playing a base and bonus live card games with side betting. A video board is used for bonus game play if a predetermined arrangement of cards is dealt in the base game. When a player gets the predetermined arrangement the player can play the bonus game. The other players who made side bets, in one embodiment, are also awarded when the bonus game player wins the bonus game and, under another embodiment, when the bonus game player loses the bonus game. In other embodiments, side bets are not needed for the other players to be awarded based upon the bonus game being won or lost.

U.S. Pat. No. 5,863,041 (Boylan et al.) describe a side wager to Pai Gow poker in which an "envy bet" is taught. The "envy bet" is a side wager of a minimum amount and allows the player to also be paid, should another player receive a hand of predetermined rank.

U.S. Pat. Nos. 5,615,888 and 5,806,846 (Lofink) The game of Spanish 21 modifies Blackjack and includes a bonus on the main wager. There is an opportunity of several players winning if someone gets special predetermined cards. In Spanish 21, the player receiving the predetermined cards wins in addition to all other players.

U.S. Pat. Nos. 5,390,934 and 5,494,296 (Grassa) This reference teaches the game of Rainbow Blackjack wherein the rules of play are the same but each player is assigned a color and players are allowed to wager on each other's colors, where others can wager with a particular player.

U.S. Pat. No. 6,368,218 (Angell, Jr.) describes a method and system for gaming in which a plurality of players each connect to a host which enables players to participate jointly in the same games of chance. According to one embodiment, a computerized method of gaming is provided that includes connecting a plurality of players to a host remotely located from the plurality of players. Each player jointly participates in a turn-based game of chance. FIG. 1 shows a computerized gaming system according to one embodiment of that invention. The system includes a plurality of clients, for example, personal computers, coupled to a host server. Connection can be a via a local or wide area network, a point to point network provided by telephone services, or other communication network. According to one embodiment, the clients (hereinafter "players") are users of home personal computers coupled to host server via an internet connection. Thus, the foregoing system enables a player to connect to server remotely (for example, from the player's home) to play games of chance supported on the server.

Published US Patent Application Document 20070111775 (Yoseloff) describes a casino table card system and method that is played on a casino card table having a playing surface. Multiple player positions on the casino card table have at least a first player position and second player position. A processor receives electronic game information comprising wager information relating to casino card games played on the casino card table. At least one player input capability from a passive player has wager input capability for placing wagers on the active player position. The wager information on the active player is electronically transmitted to the processor, which accepts input from the passive player position on an outcome at the active player position. The system resolves wagers from the passive player on events at an active player position.

Every reference cited herein is incorporated herein by reference in their entirety.

In these various gaming systems, there are still significant improvements that can be made. Certain of the formats, for example, especially where used with back-bets, in which second players (not seated at the table) make wagers on individual player positions. It is often annoying to players at the table when secondary players request or place additional wagers on other players at a gaming table. Additionally, kibitzing or suggesting modes of play different from the primary player' strategy can be distracting. It is desirable to provide a system that can be used to increase wagers at individual tables and eliminate some of the potential for interpersonal conflict.

SUMMARY OF THE INVENTION

A wagering game and apparatus for enabling play of that game has a processor identify wagers, reports wagering game results and resolves wagers. In combination with this underlying electronic gaming apparatus may be:

a) a gaming apparatus having a player position and first player input controls at the player position;
b) the processor in communication with the first player input controls;
c) a first player seat at each first player position;
d) a second player input control associated with the player seat and more distal from the gaming apparatus than the first player seat;
e) the second player input control in communication with the processor and having second player input controls that enable wagering on any wagering game played on the gaming apparatus; and
f) the processor configured to accept wagers from both the first player input controls and the second player input controls and to resolve wagers from the first player input controls and the second player input controls based upon game outcomes on the gaming apparatus.

DETAILED DESCRIPTION OF THE INVENTION

Figure 1:
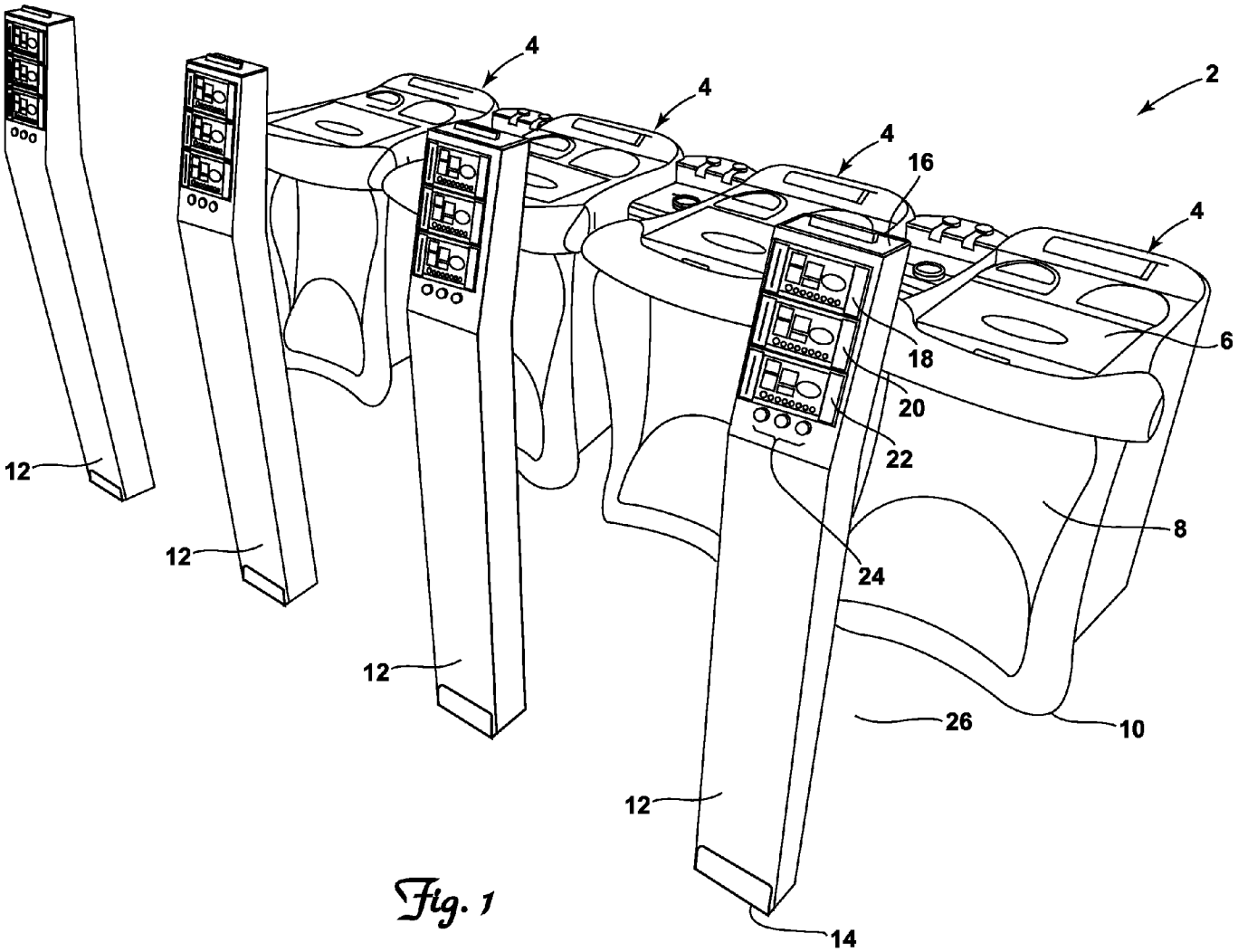
FIG. 1 shows a multiplayer gaming system for back-betting according to the present technology.

A wagering game and apparatus for enabling play of that game has a processor identify wagers, reports wagering game results and resolves wagers. In combination with this underlying electronic gaming apparatus may be:

a) a gaming apparatus having a first player position and first player input controls at the first player position. The first player position is typically at a video console for any underlying video-type wagering game or any other game with an electronically determinable or reportable outcome in the underlying game. The first player position comprises a chair and player input controls with a monitor to display gaming content, wagering results, credits and enable player input (but buttons or touchscreen, for example).
b) the processor in communication with the first player input controls. All control of the game and game strategy is input through the first player position. The second [player input controls should not have any ability to direct game strategy unless the first player withdraws (surrender, fold, etc.) from the underlying game during play of a game.
c) a first player seat at each first player position. The seat may be fixed or swivel, but seat should be dedicated to a single gaming apparatus/player position during use. It is preferably part of a secondary player gaming terminal, as further described herein.
d) a second player input control associated with the player seat and more distal from the gaming apparatus than the first player seat. By distal, it is mean that the first player seat is between the second player input terminal and the primary gaming apparatus. It is important that the cushioned seat area for the first player is not directly in contact with the second player terminal so that physical motion, vibrations, impact etc. on the second player input terminal does not immediately affect the first player seat. The sole connection between the second player terminal and the first player seat would be the second player terminal extending down to a support base (e.g., a plate), the plate extends forward towards the primary gaming apparatus, the plate may be secured to a base supporting the first player seat, and the first player seat is supported on the base. This will minimize direct transmission of movement by a second player to the first player. If the second player terminal, for example, were directly attached to the first player seat back, the motions and actions of the second player would be an annoyance to the first player, which is to be avoided. The plate and the base may be secured to the floor to further reduce motion transmission.
e) the second player input control in communication with the processor and having second player input controls that enable wagering on any wagering game played on the gaming apparatus. There may be one, two or three input functions on the second player terminal, so that the second player may enter multiple individual games or individual game positions in that second player's view. and
f) the processor configured to accept wagers from both the first player input controls and the second player input controls and to resolve wagers from the first player input controls and the second player input controls based upon game outcomes on the gaming apparatus.

The wagering game apparatus may, as indicated above, have the second player input controls are physically secured to the first player seat through a floor mounting, but not directly to the seat itself. The second player input controls may be physically secured to the first player seat without direct physical contact with a cushioned seating area on the first player seat, as described above. The second player input controls may comprise a standing terminal secured to the first player seat through only a stand on the first player seat. The second player input controls are hardwired to the processor or in communication through a wi-fi connection.

The present gaming technology may be alternatively described as including a wagering game apparatus (preferably electronic) in which a processor identifies wagers, reports wagering game results and resolves wagers. The apparatus and system may have at least"

a) a gaming apparatus having a player position and first player input controls at the player position. The input controls should enable entry of amounts of wagers, game selection (e.g., where the apparatus allows for multiple choices among games, such as poker variants, keno variants, blackjack, baccarat, and the like), strategy execution where allowed in the game; accounting functions (e.g., credit input, credit recognition, currency recognition, Ticket-in, Ticket-out functionality, access to a main or central casino server).

b) the processor is in communication and has a communication link with the first player input controls;

c) a first player seat at each first player position. The seats may or may not be fixed or secured to the gaming apparatus and first player terminal;

d) a second player input control associated with the player seat and more distal from the gaming apparatus than the first player seat;

e) the second player input control in communication with the processor and having second player input controls that enable wagering on any wagering game played on the gaming apparatus. Credit and wager controls should be available on the second player input control; and f) the processor is configured to accept wagers from both the first player input controls and the second player input controls and to resolve wagers from the first player input controls and the second player input controls based upon game outcomes on the gaming apparatus.

The wagering game apparatus may have the second player input controls physically secured to the first player seat or the second player input controls are physically secured to the first player seat without direct physical contact with a cushioned seating area on the first player seat. The indirect connection, for example, may be effected with the second player input control on a stand, column, tree, post or the like on a base. The base may be structurally supported or secured to a plate or the floor, and the plate or floor extends to the base of the seat. Vibration damping between the second player input controls and the seat.

The second player input controls may comprise a standing terminal secured to the first player seat through only a plate and stand on the first player seat. The second player input controls may be hardwired to the processor or the second player input controls may be in a wireless communication link to the processor. The wagering game apparatus may have the second player input control with multiple player input controls on a single stand, column, tree or the like.

The wagering game apparatus may have the multiple player input controls are positioned at different angles of rotation about vertical on the stand. The second player input control preferably is a touch screen entry system in communication with the processor. The wagering game apparatus may provide the first player input position with a lock-out entry capability which indicates to the processor that secondary player input controls are blocked from wagers at the wagering game apparatus associated with the first player input position. The second player input control may have a prominent display indicating that the blocked wager is in effect.

A casino table is provided for use by players in a casino. Standard wagering procedures are followed for any available underlying wagering game played between players or preferably with players against the house (such as, without limit, Blackjack, baccarat, Keno, bingo, Blackjack variants, Three-Card Poker™ games, Four-Card Poker™ games, Crazy Four Poker™ games, Let It Ride™ poker, Caribbean Stud® poker, Pai Gow poker, 3-5-7 poker, and the like). The standard format of wagering and play of these electronic casino table games and (virtual or physical) playing card games is minimally impacted by the practice of the technology. The underlying wagering by the active players at the table is done in a standard manner according to the format at the table. This includes physical placement of chips, player wager systems (touch pads, touch screens, buttons, key pad, token or coin inserts, proximity detectors, personal data entry systems, hardwired systems, wireless systems, and the like). Active players (alternatively first players or primary players) are those players playing the live game at the gaming table, while passive players (alternatively second players or secondary players) place wagers on the terminal wagering component of the present technology and [preferably have no impact on the game play. An active player can play passively at the same time by placing wagers on other player hands via the second player terminal.

The present technology allows for individual players or even passersby to place wagers on one or more players other than themselves by communication with a processor based wagering system. The processor based wagering system may be the sole wagering basis on the table or may be a supplement to a physical wagering system, when the physical wagering system provides an electronic result that can be used by the processor (including game controller) to resolve an electronic wager. An advantage of the supplemental format to a physical wagering system is that the wagers by passive players tend to be less observable by others. The wager entry system for the passive players may be wireless, hardwired or attached (for security, with or without a line connection) at player positions.

As the passive wagering on the individual player input terminals (IPTs) must be account-based in at least some format, it is desirable that the IPTS have some level of security and allow wagering only by authorized persons up to the authorized limit on the account of that individual and the IPTS. As will be shown, this technology may be played on a wide array of electrical and electromechanical formats, including live player tables with fixed electronic player (and/or non-player) wager entry capability, live player tables with wireless electronic player (and/or non-player) wager entry capability and live players playing on tables equipped with highly automated casino table game data acquisition devices. An important element of the play of any of the systems of the presently described technology is the ability to make the wager on another player's hand without additional chips being placed on the table for the wager, without the wagering altering the odds, jackpots, bonuses or payouts of the player (whose hand is being wagered upon), preferably the system operating without the active player realizing that others passive wagers are being placed on that player's hand, and with all passive wagers being handled by an account-based credit and debit system, without payment in currency or chips at the gaming table.

One exemplary data acquisition system is referred as the Intelligent Table System™ Components of this system are distributed by Shuffle Master, Inc., IGT and Mikohn Gaming, Inc. Intelligent Table System™ gaming system products comprise automated or partially automated systems that include some or most of such devices as automatic card shuffling machines, automatic card shuffling with card reading and information (e.g., card suit, rank and order) transmission capability, card discard trays with card reading and information (e.g., card suit, rank and order) transmission capability, wager sensing systems (for at least the presence of wagers or the actual amount of wagers and the specific events upon which wagers have been placed, such as an Ante wager, play bet wager, bonus wager, jackpot wager, progressive jackpot wager, envy bet wager, side bet wager and the like), imaging systems and RFID (radio frequency identification) sensing reading systems (for cards and/or for chips), round counting elements and systems, and the like. The components are available from Shuffle Master, Inc., and are disclosed in such patents and patent Applications such as U.S. Pat. Nos. 6,655,684; 6,651,982; 6,651,981; 6,588,751; 6,588,750; 6,568,678; 6,325,373; 6,254,096; 6,149,154; 6,139,014; 6,068,258; Published U.S. patent application 2005/0206077; 2005/0146093; 2005/0113166; 2005/0140090; 2005/0104290; 2005/0104289; 2005/0093231; 2005/0093230; 2005/0082750; 2005/0062229; 2005/0062228; 2005/0062227; 2005/0062226; 2005/0051956; 2005/0026682; 2005/0026681; 2005/0023752; 2005/0012269; 2004/0245720; 2004/0224777; 2004/0169332; 2004/0108654; 2004/0067789; 2003/0094756; 2003/0090059; 2003/0075865; 2003/0073498; 2003/0067112; 2003/0064798; 2003/0052450; 2000052449; 2003/0042673; 2002/0163125; 2002/0070499; and 2002/0063389. Each of these patents and patent applications and all other patents and patent applications referenced in this disclosure are incorporated herein by reference for their entire disclosure.

The technology and systems described herein may include a minimum of a casino table game (preferably an electronic game or an electronically monitored casino table card game, but they are also applicable to roulette, Casino War™ game, keno, bingo, wheel games, and craps), player positions and wagering positions for players, an electronic communication systems, a game processing system in data communication with the electronic communication system, an individual player accounting system in data communication with the game processing system, game outcome input in communication with the game processing system, and at least one individual input device that can input wagers on more than one player game outcome as determined by the game processing system. The terminology of "on more than one player game outcome" means that any individual or input system user with authorized access to the communication system associated with a gaming table may place a wager on any player position chosen or event outcome by that individual or user. The input, unlike traditional devices, is not limited to making a wager entry from a single player position onto that single player position's game outcome. For example, in standard electronic input devices, a first player at a table has a first player input device that allows that first player to make a wager on the first player's game outcome. The term "on more than one player position" requires that the first player input device allows wagering on not only the first player position, but at least one player position other than the first player position (e.g., second player position, third player position, fourth player position, etc.). In fact, although the first player wager input system must allow input on the other player positions, and although it is desirable to allow the first player to make electronic (and hence hidden from others) additional wagers on the first player's outcome, it is not essential that the first player wagering input system allow additional wagers on the first player position outcome. Thus, the term "one more than one player position" actually means and includes wagering at a player position other than that controlled actively by the first player, or in the case of a passive player such as a non-player (at the table) can wager on any position at the table. In a preferred embodiment, the second player may wager only on a first player position physically (locationally (as directly behind or generally behind) a single first player position.

The communication system, as previously indicated may be supported on any available array of technology. The computer system may include a memory medium(s) on which one or more computer programs or software components enabling system intelligence and software may be stored. For example, there may be graphical programs stored on the memory medium of the personal IPTs intelligence enabling communication with a computer system. Also, a memory medium may store a graphical programming development environment application used to create the graphical program, as well as software operable to convert and/or deploy the graphical program on the device (IPTs). The various memory media on the IPTs, game processor, accounting processor, table processor, central processor, communication support processor and the like may also each store operating system software, as well as other software for operation of the communication, gaming and computer system. It is preferred that the IPTs are merely slave devices or essentially input devices without substantive game control processing, but only or primarily entry, communication and display functions.

The term "memory medium" is intended to include an installation medium, e.g., a CD-ROM, floppy disks, chip, ASIC, field programmable gated array (FPGA) or tape device; a computer system memory or random access memory such as DRAM, SRAM, EDO RAM, Rambus RAM, etc.; or a non-volatile memory such as a magnetic media, e.g., a hard drive, or optical storage. The memory medium may comprise other types of memory as well, or combinations thereof. In addition, the memory medium may be located in a first computer in which the programs are executed, or may be located in a second different computer which connects to the first computer over a network, such as the Internet. In the latter instance, a second computer may provide program instructions to the first computer for execution.

In the present technology, the term "graphical program" or "block diagram" is intended to include a program comprising graphical code, e.g., two or more nodes or icons interconnected in one or more of a data flow, control flow, or execution flow format, wherein the interconnected nodes or icons may visually indicate the functionality of the program. The nodes may be connected in one or more of a data flow, control flow, and/or execution flow format. The nodes may also be connected in a "signal flow" format, which is a subset of data flow. Thus the terms "graphical program" or "block diagram" are each intended to include a program comprising a plurality of interconnected nodes or icons which visually indicate the functionality of the program. For example, to enable and to simplify wager placement at a specific table, different formats of wagering entry (including graphical programs) may be available.

Wager entry through the system must be able to provide entry that specifies a table, a wager position, a player identity, a format of wager and the amount of wager. The amount of the wager applied is done after the IPTs user's individual account has been authorized for placement of the wager or if the IPTs (hereinafter referred to as a debit-IPT) is provided with a purchased, prepaid balance (either by direct credit, ticket [ticket-in, ticket-out, TITO] or currency entry or much like a debit card) that can be authorized for use within a casino or within any casino that has authorized use of that debit-IPT. This element also constitutes a novel approach to account control and account security at casinos. The data entry may therefore be in the format of fill-in-the-blanks, as with an alphanumeric entry.

Alternately, a player tracking card that accesses a system that stores a portion of this information can be used. Then only wager types, amounts, table position and table number must be entered. The other wagers may be made as the game progresses. This actually allows for a passive player (e.g., a first player making a wager on another player's hand) to exercise slightly different strategies without interfering with the play of the another player's hand, such as making a surrender in Blackjack, a double down in blackjack, a higher player wager in underlying games or wagers, folding in a competitive poker game, and the like. These actions would not alter the play of the game.

Using the Intelligent Table System™ or similar systems, cards are read in the shuffler and/or a dealing shoe, and the value or rank of hands is known in advance. That is, as the cards and the order of cards is known in the shuffler or the shoe before the cards and the respective hands are known, as the number of players is known, as the rank of each player's hand and the rank of the dealer's hand are known, and as the rules of the game and relative rank of hands is known to the game processor, the entire gaming system knows in advance of each deal what the win/loss outcome will be before dealing. The system does not control win/loss events, but it recognizes them. Because of this Intelligent Table System™ capability, the system knows the outcome of the gaming events for each hand and the receipt of a distal wager through an IPT platform does not change the play of the physical (or quasi-physical) game and wagers at the table. The system can record the wager and payout on the wager from the IPTs and reflect the resolution of the wager in an account balance.

The ability of the passive player to vary strategy (essentially only wagering strategy as the distal player cannot alter the selection or discarding of cards or selection of virtual frames or keno numbers or bingo numbers) is even greater in other games that may be played at casinos, where the actual amount of the Play wagers may be varied with respect to the amount of the Ante wager (i.e., within a range of) times or 1×, or 2×, or 3×, or 4×, or 5× the amount of the Ante wager.

This variation in wagering strategy can even be effected in Blackjack where the number of cards in a play strategy can also be varied by the passive player. This can be exemplified in two ways. For example, if the live player wants a hit and the distal player wants to double down, the live player controls the actual activity on the table, yet the distal player may still place the double down wager. If the live player subsequently stands after the one hit, there is no need for special considerations in resolving the wager, as the live player will win or lose with the single hit and so will the distal player. However, as an example, if the live player takes a normal hit with a count of 11 and the distal player wants to double down, the IPT system will enter a double down wager on behalf of the distal player and record such a wager. When the live player gets a 3 for the first hit, that live player may wish to continue hitting, which is inconsistent with the double down IPT wager. The rules of the system may do the following and may allow modification of the wager by the distal player. The rules of the system, either imposed or elected by the distal player, may allow for: 1. the double down bet to be withdrawn; 2. may allow it to be converted to a regular wager; or allow the automated reading system of the Intelligent Table™ system to read the prospectively determined results (as if the player had not taken a subsequent hit but remained with the first hit) and determine the outcome of the double down. The Intelligent Table System™ is sufficiently sophisticated that it can read through the cards in the remaining hands and make a true determination of the results, as if the intervening events were not there. This is done by reading the cards and determining the predicted results. This is easiest when the live player selected is at Third Base (immediately in front of the dealer), but by applying rules, the effect can be implemented at any position. Hits may be assumed according to best methods selection or the like.

Non-limiting examples of graphical program development environments that may be used to create graphical programs on the IPTs system include LabVIEW™, DasyLab™, and DiaDem™ from National Instruments, VEE™ from Agilent, WiT™ from Coreco, Vision Program Manager™ from PPT Vision, SoftWIRE™. from Measurement Computing, Simulink™ from the MathWorks, Sanscript™ from Northwoods Software, Khoros™ from Khoral Research, SnapMaster™ from HEM Data, and VisSim™ from Visual Solutions, ObjectBench™ by SES (Scientific and Engineering Software), and VisiDAQ™ from Advantech, among others. In the preferred embodiment, the system uses the LabVIEW™ graphical programming system available from National Instruments. In the use of more graphical representations on the IPT to supplement distal wagering with less, little or no alphanumeric component entering, the displayed options of the passive player making wagers may be displayed in icons or written text on the display face, and the user merely presses a touch-sensitive panel on the terminal associated physically with or around a player chair to enter the information.

FIG. 1 shows a schematic of the location of elements within a casino table wagering system 2 using Individual Player Input Systems 4. The system 2 is shown with four casino gaming card tables or video\consoles 12 within immediate communication range of a fixed position Individual Player Input System and the consoles 12 are located directly behind and secured to a player chair (not shown). The IPT has virtual text 18, 20 22 that can be accessed by the user to provide a signal of input by a passive player, as by a touch screen. The IPT consoles 12 have a wireless output component 16 that is shown in wireless communication with a receiving device 16 that may be only a receiver/transmitter or may also contain processing capability. The information, which is described in greater detail herein relates to the placing of a wager at a player position at one of the tables or video consoles 12 within immediate communication range, here particularly farthest right console 12 and selecting one of the four player positions for placing a particular wager. The receiving device 6 is unlikely to have the account function capability stored on the individual player input systems 4 and so the necessary information on account activity may be sent along a communication path which may be hardwired or wireless to either a local processing system (not shown) or then again to a central processing system (not shown) where the account balancing and transaction events are authorized and performed. It is possible that a node network or mesh network may be established among all transmission links, as described in U.S. patent application Ser. No. 11/223,341 filed Sep. 9, 2005, which application is incorporated herein in its entirety by reference. This type of system enables transmission of data across a network that is not limited to the table itself. For example, if the receiver 6 were blocked or out of order o a console 4, the node network or mesh network would allow a receiver at a different console 4 to receive the transmission, which has identified the table and position of the wager, through its own communication link or communication connection to the processing units. These IPT systems may be installed at a secondary (not at the table itself) position associated with a specific table and a specific player position at a table to allow players at one secondary position (such as position a) to place a passive wager at another primary position.

One aspect that should be considered is the possibility that a wager may be made through an IPT on a progressive jackpot wager. The win by a player at the table must be for the entire amount of the jackpot and would not be shared with another passive player betting on the tabled player's hand. Splitting the jackpot would be an unsatisfactory result for the tabled player and would discourage play of that particular game. There is no such potential for frustration in winning a multiplier event or even fixed amount bonus, as that would not be split and the casino would not have to double what would tend to be the very large amount of a progressive jackpot.

Figure 2:
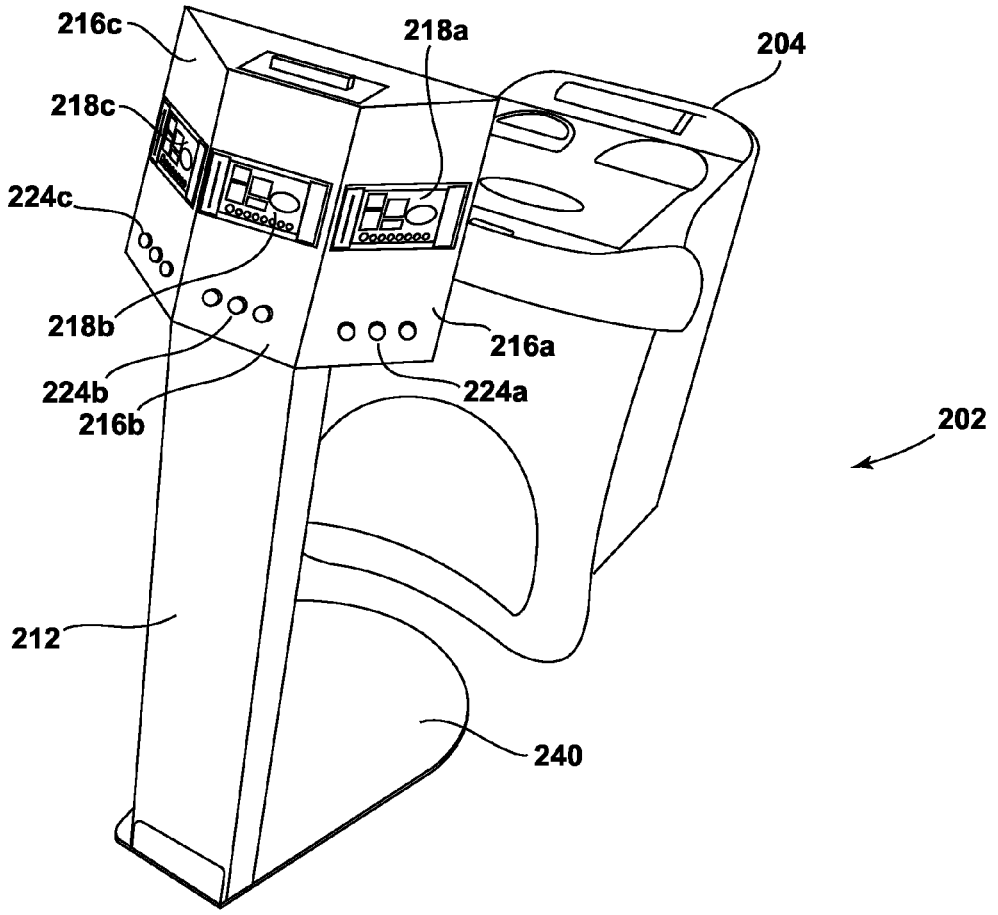
FIG. 2 shows a single terminal with multiple player back-bet stand supported on a base plate.

FIG. 2 shows a different location of elements within a casino table wagering system 202 an Individual Player Input Systems 204 with three side-by-side displays 218*a*, 218*b*, 218*c*, three button systems 224*a*, 224*b* 224*c* on three attached to angled sides 216*a*, 216*b* 216*c* on a single stand 212 having a floor support 240.

Figure 3:
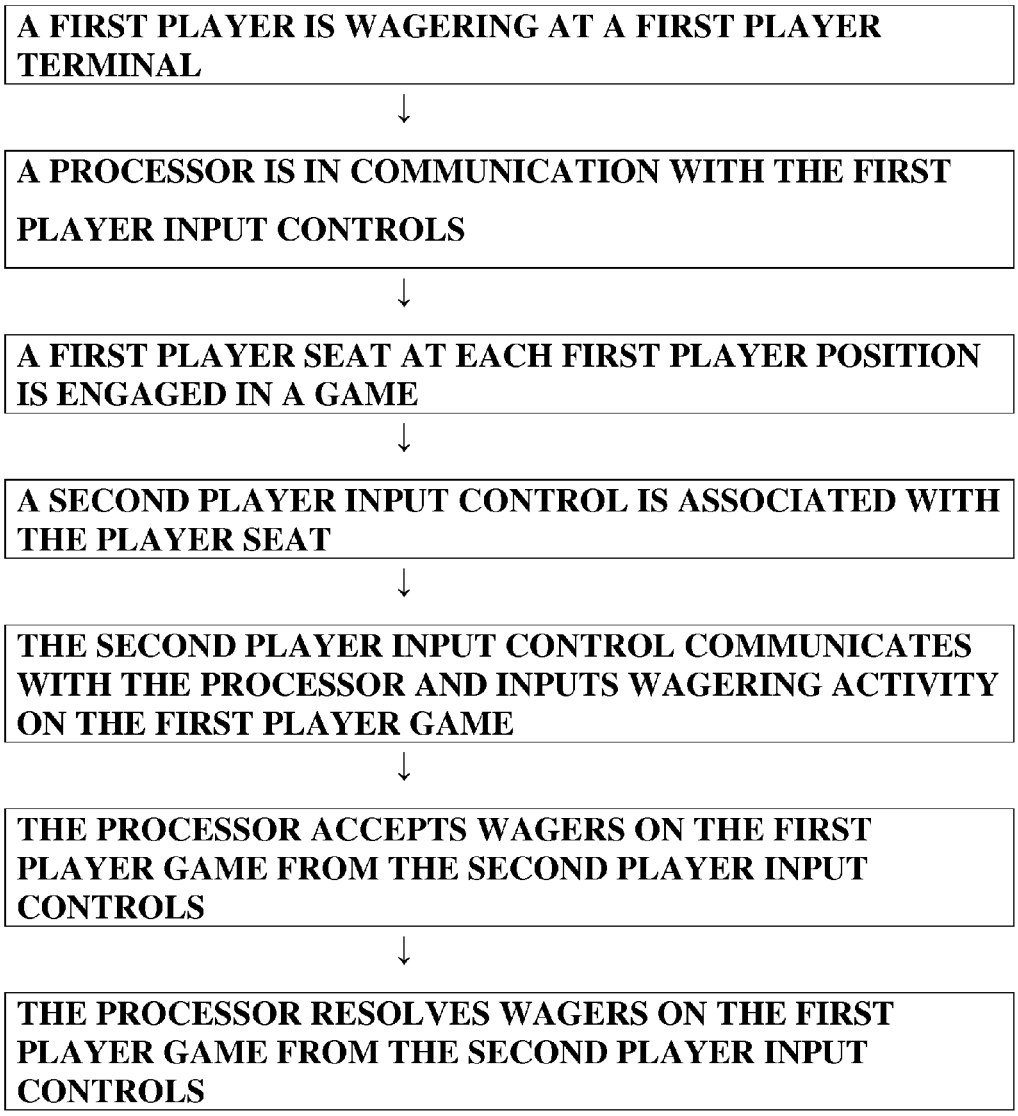
FIG. 3 shows a flow diagram for a method according to the present invention.

FIG. 3 similarly shows a flow diagram for an alternate process of accounting and wagering with a prepaid IPT.

A specific example within the generic concept of the teachings herein of a specific Matrix is a configuration for collecting data on active play on a blackjack table. Three separate banks of serial sensor boards are in individual (board-by-board) direct connection to a system logic control. The system logic control need not be a processor or microprocessor or other processing capable element, but may be a field programmable gated array that acts as an interface between the sensor boards and a processor (CPU). An intelligent card handling device (e.g., an intelligent blackjack shoe, an intelligent shuffler, and/or intelligent discard rack) is in communication connectivity (e.g., TCP/IP) with the processor or control computer (CPU). The processor/CPU then is in communication with the ITS database, for example communicating by way of a TCP/IP connection. It is to be noted that Assignee's copending U.S. patent applications Nos. 20050062227; 20050062226; 20050051955; and 20050012270; and previously commonly assigned video games in 20050059459 contain FPGA intermediate circuitry. These applications are also incorporated herein by reference.

The configuration includes a family of sensor boards, system control logic (e.g., the FPGA or ASIC), a CPU and intelligent card handling system. The intelligent card handling system communicates (preferably via TCP/IP connections) to the CPU and the sensors communicate by the system control logic and serial interfaces. The sensor boards and the intelligent card handling systems perform a data acquisition function (as in FIG. 3). The collected data (which in this instance may be light data, RFID data, etc.) in the system control logic (e.g., FPGA, ASIC or other intermediary logic function) may be sent by serial interface to the CPU control processor. All data and/or signals eventually pass through or are collected in the CPU.

The control computer (CPU) combines the information collected from the table or video gaming system (which includes keno and bingo terminals also) by all sources (e.g., at least the gaming processor or in live casino table card games, a shoe/shuffler sensor and the table sensors) and is capable of identifying all cards dealt to each player position and the dealer position, and senses the wagers made at each player position and can discriminate among the various types of wagers ate various times in the play of the game. It can detect activities such as surrender, insurance, double downs, splitting hands, busts, blackjacks, and the like. An example of a commercial CPU that can be programmed according to the needs of such a Table Matrix system for blackjack is a GENE-6310, which features a 3.5 inch SubCompact Form factor, Onboard VIA Eden Series 400/667 MHz, C3 1 GHz EBGA mobile CPU; integrated AGP 2D/3D graphics accelerator; dual channel LVDS interface onboard; integrated AC97 2.0 SoundBlaster™ board-compatible legacy audio; 10/100 Base-T fast Ethernet; 2 or 4 COMs/1 parallel/4USBa/1 trDA; and capable of supporting CRT and 36 Bit TFT panels, NTSC/PAL TV output, and Type II compact flash memory.

In embodiments of the described technology, the communication services may be provided through the use of a wireless network interface system that is capable of interfacing between a signal providing component and a communication system with an ultimate signal destination. In some instances, such an interfacing capability is performed by elements of a "demarcation device," and specific examples of how the demarcation capabilities arise in different embodiments of the network interface systems are discussed below. Merely by way of illustration, such demarcation capabilities may derive from elements comprised by the following examples of demarcation devices: a set-top box (e.g., table node), which may be used as an interface between a customer's (player's) signaling appliance and a casino's communication network; broadband modems, including any format of wireless modems, each of which may be used to provide any signal, including but not limited to digital signals, analog signals, state signals, sensed event signals, and/or data signals within a gaming environment premises; integrated access devices; and the like. One particular demarcation device whose elements may be used to provide demarcation capabilities includes a network interface device ("NID"), described in detail below. In some instances, a demarcation device may additionally include other capabilities, including, for example, the capability to separate received communication information into discrete sets; the capability to process certain of the separated sets independently from other sets; and/or the capability to transmit different of the separated sets to different locations, perhaps through the use of different interfaces. Integration of one or more microservers with the NID has significant advantages when compared with solutions in which microservers are separate from the NID. For instance, separate microservers may require access to a customer premises for services and may be moved around and removed from the customer locations. By integrating the microservers with the NID, they are easily accessible by a technician and may be integrated in a secure fashion as described below that makes them nonremovable by others.

In describing embodiments of the technology, references to "player locations" are intended to refer to physical locations or structures at which a player engages in gaming. Wireless sensor networks as described herein will drive the next phase of explosive growth in the use of more automated systems in the gaming industry. Technological improvements and cost reduction of low-data rate transceivers, low power microprocessors, MEMS (microelectromechanical system) sensors, and embedded programming languages will unleash the development of a new class of fully autonomous computing and communications devices in form factors smaller than a box of matches.

What is claimed:

1. A wagering game apparatus in which a processor identifies wagers, reports wagering game results and resolves wagers comprising:

A) a gaming apparatus has a first player position with a first player seat, video display, the processor and first player input controls accessible at the first player position;

B) the processor is in communication with the first player input controls and the video display at the first player position;

C) the first player seat is at the first player position;

D) a second player input control enabling input from multiple players at multiple screens and multiple inputs on a single stand that is positioned directly behind the first player seat and the second player input is more distal from the gaming apparatus than the first player seat and behind the first player seat;

E) the second player input control is in communication with the processor and has second player input controls that enable wagering on any wagering game played on the gaming apparatus at the first player position; and F) the processor is configured to accept wagers from both the first player input controls and the second player input controls and to resolve wagers from the first player input controls and the second player input controls based upon game outcomes on the gaming apparatus at the first player position.

2. The wagering game apparatus of claim 1 wherein the second player input controls are physically secured to the first player seat.

3. A method of multiple players playing a single wagering game on the wagering game apparatus of claim 2 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

4. The wagering game apparatus of claim 1 wherein the second player input controls are physically secured to the first player seat without direct physical contact with a cushioned seating area on the first player seat.

5. A method of multiple players playing a single wagering game on the wagering game apparatus of claim 4 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

6. The wagering game apparatus of claim 4 wherein the second player input controls comprise a floor mounted terminal secured to the first player seat through only a stand on the first player seat.

7. A method of multiple players playing a single wagering game on the wagering game apparatus of claim 6 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

8. The wagering game apparatus of claim 4 wherein the second player input controls are hardwired to the processor.

9. A method of multiple players playing a single wagering game on the wagering game apparatus of claim 8 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

10. The wagering game apparatus of claim 4 wherein the second player input controls are in a wireless communication link to the processor.

11. A method of multiple players playing a single wagering game on the wagering game apparatus of claim 10 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

12. The wagering game apparatus of claim 1 wherein the second player input control comprises multiple player input controls on a single stand.

13. A method of multiple players playing a single wagering game on the wagering game apparatus of claim 12 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

14. The wagering game apparatus of claim 12 wherein the multiple player input controls are positioned at different angles of rotation about vertical on the stand.

15. A method of multiple players playing a single wagering game on the wagering game apparatus of claim 14 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

16. The wagering game apparatus of claim 1 wherein the second player input control comprises a touch screen entry system in communication with the processor.

17. The wagering game apparatus of claim 1 wherein the first player input position has a lock-out entry capability which indicates to the processor that the second player input controls are blocked from wagers at the wagering game apparatus associated with the first player input position.

18. The gaming apparatus of claim 17 wherein the second player input control has a prominent display indicating that the blocked wager is in effect.

19. A method of multiple players playing a single wagering game on the wagering game apparatus of claim 18 comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

20. A method of multiple players playing a single wagering game on the wagering game apparatus comprising A) a gaming apparatus has a first player position and first player input controls accessible at the first player position;

B) the processor is in communication with the first player input controls;

C) a first player seat is at the first player position;

D) a second player input control enabling input from multiple players at multiple screens and multiple inputs on a single stand that is positioned directly behind the first player seat and the second player input is more distal from the gaming apparatus than the first player seat and behind the first player seat;

E) the second player input control is in communication with the processor and has second player input controls that enable wagering on any wagering game played on the gaming apparatus; and F) the processor is configured to accept wagers from both the first player input controls and the second player input controls and to resolve wagers from the first player input controls and the second player input controls based upon game outcomes on the gaming apparatus; and the method comprising:

the first player placing a wager through the first player input controls on a single game displayed at the first player input position;

the second player placing a wager through the second player input controls on the single game played at the first player position;

the processor executing code to initiate the single game and resolve the first player wager and the second player wager based upon a random outcome provided by the processor on the single game.

* * * * *